US005918571A

United States Patent [19]

Below

[11] Patent Number: 5,918,571

[45] **Date of Patent: *Jul. 6, 1999**

[54] DUAL ELECTRODE HIGH THREAD SPARK PLUG

[75] Inventor: Matthew B. Below, Findlay, Ohio

[73] Assignee: Allied Signal Inc., Morristown, N.J.

[ * ] Notice: This patent is subject to a terminal disclaimer.

[21] Appl. No.: 08/924,109

[22] Filed: Sep. 5, 1997

Related U.S. Application Data

[63] Continuation-in-part of application No. 08/603,004, Feb. 16, 1996, Pat. No. 5,697,334.

[51] Int. Cl.[6] ..... H01T 13/08; H01T 21/02

[52] U.S. Cl. ..... 123/169 R; 123/169 E; 313/137; 313/144; 445/7

[58] Field of Search ..... 123/169 R, 169 E, 123/169 EL, 169 PH, 169 MG; 313/141, 143, 137, 144; 445/7

[56] References Cited

U.S. PATENT DOCUMENTS

| | | | |
|---|---|---|---|
| 1,335,797 | 4/1920 | Rohde | 123/169 E |
| 2,944,178 | 7/1960 | Schaub | 313/141 |
| 4,730,582 | 3/1988 | Linsay | 123/169 MG |
| 4,989,557 | 2/1991 | Penny | 123/169 EL |
| 5,014,656 | 5/1991 | Leptich et al. | 123/169 EL |
| 5,091,672 | 2/1992 | Below | 313/143 |
| 5,258,684 | 11/1993 | Matesco | 313/141 |
| 5,697,334 | 12/1997 | Below | 123/169 R |

*Primary Examiner*—Willis R. Wolfe
*Assistant Examiner*—Hieu T. Vo

[57] ABSTRACT

A spark plug (80) having a center electrode (82) with a cylindrical body and having a tip (84) at one end and a terminal (123) near the other end with an insulator (86) extending around the center electrode (82). A ground shield and retainer unit extends around the insulator (86) and includes a threaded portion (88) near one end and a ground electrode (85) near the other end, having a portion thereof aligned with the center electrode tip (84) to form a spark gap, with a sealing portion (92) disposed therebetween for sealing the engine combustion chamber from the outside environment when the spark plug (80) is installed. The ground shield and retainer unit can be formed from two parts (88,90) which are deformed during manufacturing to be in mechanical engagement and securely holding the insulator (86) in place. The spark plug (80) can also have two or more center electrodes (82,84) with two or more corresponding ground electrodes (83,85) projecting from the ground shield (90).

21 Claims, 4 Drawing Sheets

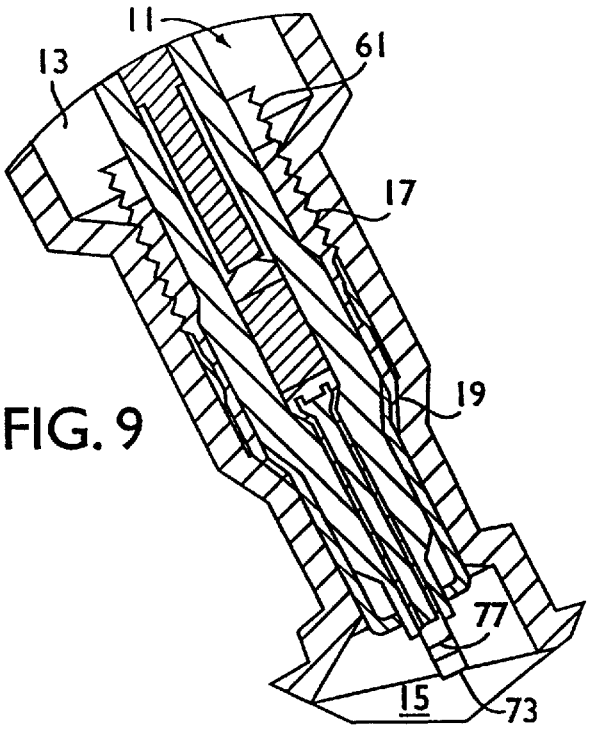
FIG. 9
FIG. 10
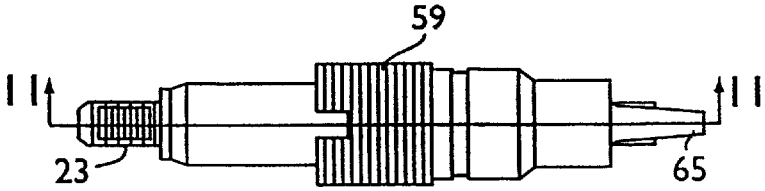
FIG. 11
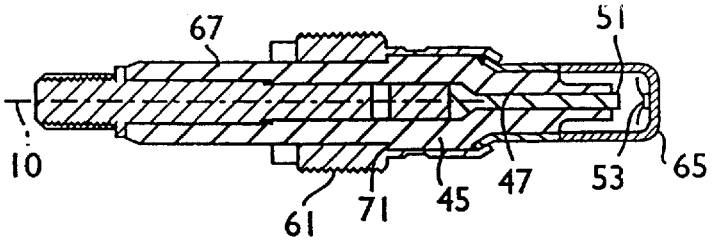
FIG. 7
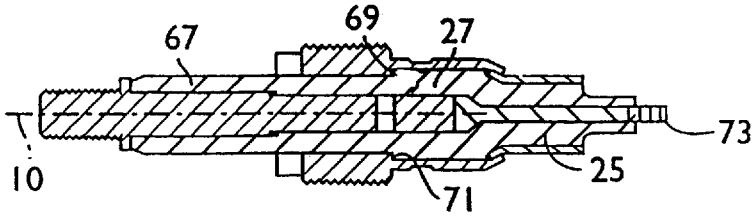
FIG. 8
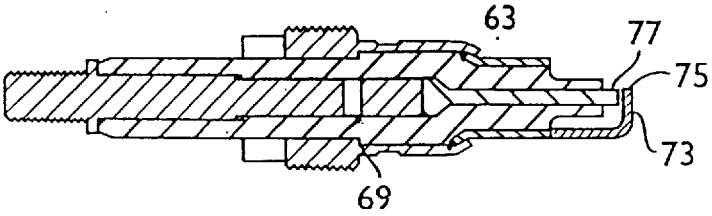

DUAL ELECTRODE HIGH THREAD SPARK PLUG

CROSS-REFERENCES TO RELATED APPLICATIONS

This application is a continuation-in-part of U.S. patent application Ser. No. 08/603,004 titled "Spark Plug with Integral Retainer Nut" filed Feb. 16, 1996 now U.S. Pat. No. 5,697,334 and assigned to the assignee of the present application.

BACKGROUND OF THE INVENTION

1. Field of the Invention

The present invention relates generally to spark plugs for internal combustion engines and more particularly to a spark plug having two electrodes and an annular threaded portion for engaging the engine with the spark plug seat located between the spark gap and the threaded portion.

2. Description of Prior Art

Traditional spark plug construction includes an annular metal casing having threads near one end and a ceramic insulator extending from the threaded end through the metal casing and beyond the opposite end. A central electrode is exposed near the threaded end and is electrically connected through the insulator interior to a terminal which extends from the opposite insulator end to which a spark plug wire attaches. An "L" shaped ground electrode extends from one edge of the threaded end of the metal casing into axial alignment with the central electrode to define a spark gap therebetween. The force applied to seal the spark plug in the head is the result of torque transmitted by the threaded metal casing, hence, the threaded portion of the metal casing must be sturdy and of substantial size. A portion of the metal casing is formed to be engaged by a socket tool to provide torque to the threaded portion. The threaded portion is located away from the portion which is engaged by the socket tool.

To facilitate the controlled and efficient exhaust of gases from a combustion chamber, the valves are sometimes increased in size. This may necessitate a decrease in the size of the spark plug, a reduction in the size and sturdiness of the threaded metal casing end, and, in particular, a decrease in the inside diameter of the metal bore of the spark plug and a decrease in the combustion chamber wall area available to threadedly receive the spark plug.

The decrease in the inside diameter of the metal bore of the spark plug reduces the ability of the spark plug to resist carbon build up and similar deposits reducing ignition efficiency. In my U.S. Pat. No. 5,091,672 I teach a spark plug which reduces the deleterious effect of reducing the spark plug size by providing a spark plug having an insulator with a cylindrical body that surrounds a central electrode. The cylindrical body has a first diameter section separated from a second diameter section by a shoulder. A sleeve that surrounds the second diameter has an integral base that is positioned a fixed distance from the tip to the center electrode by the engagement of a flange on the sleeve with a shoulder on the cylindrical body. A radial tab that extends from the sleeve aligns with a slot in the head to establish uniform positioning of the ground electrode. A separate end or retainer nut surrounds the first diameter and engages the flange to locate and position the spark plug within the combustion chamber.

SUMMARY OF THE INVENTION

According to the present invention a spark plug is formed with one or more center electrodes disposed in a center insulator which is surrounded for a portion of its length by a ground shield with a ground electrode projecting from one end and a threaded portion formed at the other end and having a sealing portion disposed therebetween for being in sealing engagement with the engine combustion chamber when in use. The threaded portion includes means for being engaged by a socket tool to screw the threaded portion into mating threads formed in a bore which communicates with a combustion chamber of an internal combustion engine. This construction provides a unified spark plug body and integral retainer so that during removal of the spark plug, the shell seat moves away from the mating seat portion of the head bore in a helical pattern assuring continuous alignment of the shell and any surrounding carbon or other deposits. The spark plug seat moves away from the head axially while also moving radially as the spark plug is unscrewed and the entire spark plug structure is axially backed out the length of the retainer threads, thereby enhancing ease of removal of the spark plug. Moreover, the present invention achieves these solutions while retaining many of the advantageous features of my earlier patent such as minimizing the likelihood of cross-threading of the retaining nut within the cylinder head.

In accordance with another form the invention, a spark plug located in a generally cylindrical opening or bore which communicates with a combustion chamber of an internal combustion engine. The opening has a threaded portion and a generally frustoconical seat portion. The spark plug includes two or more center electrodes each having a cylindrical body with a tip at one end and a terminal near the other end. There is an insulator radially surrounding the center electrodes which has a substantially cylindrical body with at least first and second diameter sections separated by a shoulder. There is a ground shield surrounding the insulator first diameter section having near one end a frustoconical section juxtaposed with the insulator shoulder and ground electrodes extending from the other end each having a portion which is aligned with one of the center electrode tips to define therewith a spark gap. There is an annular retainer surrounding the insulator second diameter section which includes a threaded portion threadedly engaging the threaded portion of the bore and a frustoconical portion overlapping and collapsed around the ground shield frustoconical section and juxtaposed insulator shoulder securing the ground shield and retainer together as a unit with the insulator captured therebetween.

According to a further aspect of the invention, a spark plug of the type having two center electrodes each with a tip at one end and a terminal near the other end and an insulator radially surrounding the center electrodes. The insulator has a substantially cylindrical body with at least first and second diameter sections separated by a first shoulder, and second and third diameter sections separated by a second shoulder where the diameter of the second section is greater than the diameters of the first and third sections. Such a spark plug is advantageously assembled by axially passing a cylindrical shell ground shield of the type having two or more ground electrodes near one end and a flared frustoconical flange near the other end over the first diameter section so that the flared frustoconical flange engages the first shoulder. Then, a cylindrical shell retainer having an interior ledge and exterior threads on one end is axially passed over both the third and second diameter sections to engage the ledge with the second shoulder. Finally, the unthreaded end of the retainer is radially collapsed about the flared frustoconical flange to secure the ground shield and retainer together with the insulator captured therebetween.

BRIEF DESCRIPTION OF DRAWINGS

For a better understanding of the invention reference may be had to the preferred embodiments exemplary of the inventions shown in the accompanying drawings in which:

FIGS. 7 and 8 are orthogonal cross-sectional views of a spark plug showing a still further form of my invention;

FIG. 9 illustrates a portion of the spark plug of FIGS. 7 and 8 seated in the bore of an internal combustion engine;

FIG. 10 is a side elevation view of the spark plug of FIG. 6;

FIG. 11 is a view in cross-section along lines 11—11 of FIG. 10.

Corresponding reference characters indicate corresponding parts throughout the several views of the drawing.

DETAILED DESCRIPTION OF THE PREFERRED EMBODIMENTS

Figure 6:
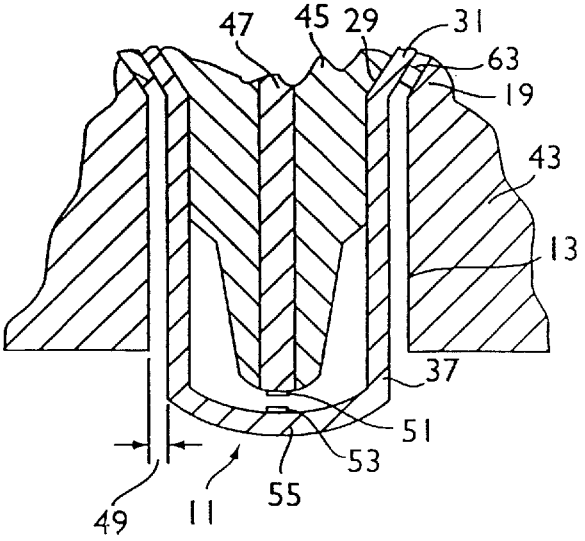
FIG. 6 is a cross-sectional view of a portion of a spark plug incorporating my invention in another form and received in the head of an internal combustion engine.

In FIGS. 6 and 9, a spark plug 11 is shown in a cylindrical bore or opening 13 which communicates with the combustion chamber 15 of an internal combustion engine. The opening 13 has threads 17 for receiving the spark plug threads 61, a frustoconical sealing seat 19, and a reduced diameter portion leading to the combustion chamber 15.

FIGS. 1–5 illustrate a radial spark gap version of the present invention. The spark plug has an axis 10 and a center electrode 21 extending the full axial length of the spark plug. The center electrode 21 has a cylindrical body with a tip 33 at one end and a terminal 23 near the other end. The center electrode 21 includes a longer than conventional center wire 47. A ceramic or similar insulator 41 radially surrounds center electrode 21. The insulator 41 has a substantially cylindrical body with first 25, second 27 and third 67 diameter sections. The second diameter section 27 is located intermediate the first 25 and third 67 diameter sections and the diameter of the second diameter section 27 is greater than that of either of the other two diameter sections 25 or 67. The first diameter section 25 and the second dissimilar diameter section 27 are separated by a shoulder 29; while, a shoulder 69 separates the second diameter section 27 and the third diameter section 67.

Figure 1:
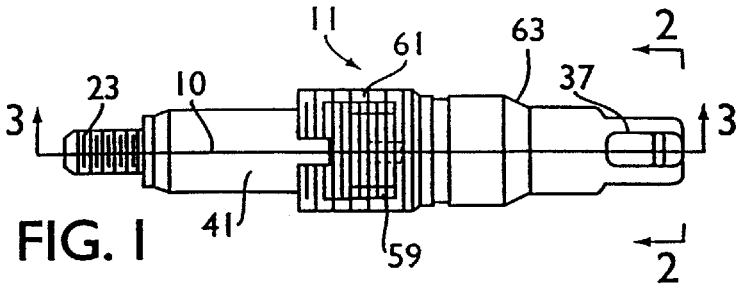
FIG. 1 is a side elevation view of a radial gap spark plug illustrating my invention in one form.
Figure 2:
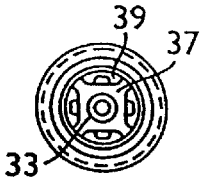
FIG. 2 is an end view of the spark plug of FIG. 1 from the right end thereof showing the radial spark gap.
Figure 3:
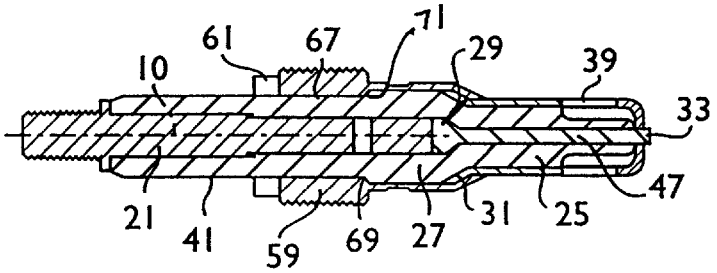
FIG. 3 is a view in cross-section along lines 3—3 of FIG. 1.
Figure 4:
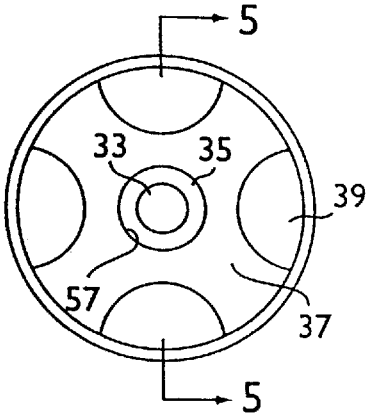
FIG. 4 is a simplified and enlarged end view similar to FIG. 2, but emphasizing the location and spacing of the electrodes
Figure 5:
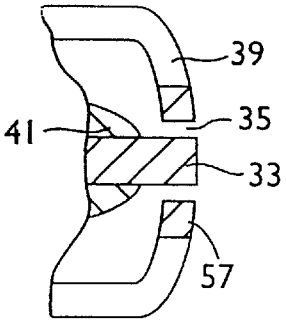
FIG. 5 is a view in cross-section along lines 5—5 of FIG. 4.

A cylindrical shell shaped ground shield 37 surrounds the insulator first diameter section 25 and including near one end a frustoconical section 31 which is juxtaposed with the insulator shoulder 29. There is a ground electrode 57 near the other end having a portion radially aligned with the center electrode tip 33 as best seen in FIGS. 4 and 5. Tip 33 and ground electrode 57 defining a radial spark gap within the annulus of opening 35. An annular retainer 59, such as a castle head jam screw, has a threaded portion 61 surrounding the third insulator section 67 and extends toward the right as viewed to also surround the insulator second diameter section 27. Threaded portion 61, of course, threadedly engages the threaded portion 17 of the generally cylindrical opening. The annular retainer 59 has a sidewall thickness in the region of the threaded portion 61 which is substantially greater than the sidewall thickness in the region overlapping the region 27. The annular retainer 59 has a frustoconical portion 63 overlapping the ground shield frustoconical section 31 and juxtaposed insulator shoulder 29 securing the ground shield 37 and retainer 59 together, as a unit, with the insulator 41 captured therebetween.

Finally, the annular retainer 59 includes a second frustoconical portion 71 which engages the shoulder 69. The insulator 41 provides a compression transmitting mechanical connection between the retainer 59 and the shield 37 which, when threaded into the engine bore 13, urges the retainer frustoconical portion 31 into engagement with the ground shield frustoconical portion 63 which, in turn, engages the seat portion 19 to establish an electrical ground between the shield 37 and engine head while at the same time sealing the combustion chamber 15 from the surrounding environment. When the retainer 59 is threaded into the bore, the retainer flange 63 is, of course, also urged into sealing engagement with the bore seat 19. The assembled annular retainer 59 and ground shield 37 function as a unit and may be referred to herein as the ground shield and retainer unit.

The embodiment of FIGS. 1–5 illustrates a radial spark gap between the tip 33 and the ground electrode 57. The partially closed end of the ground shield 37 includes a tip receiving centrally located aperture 35. Note, as best seen in FIG. 5, that the insulator 41 is axially spaced from the aperture while the tip 33 could extend through the aperture and beyond the end of the ground electrode 57. The ground electrode 57 of ground shield 37 thus radially surrounds the center electrode tip 33 to form the radial spark gap.

FIGS. 6, 10 and 11 illustrate formation of an axial spark gap between the tip 51 and ground contact 55. In this embodiment, the ground shield 37 end portion includes a generally U-shaped stirrup 65 which diametrically spans the ground shield 37 end and is axially spaced from the center electrode tip 51.

Figure 16:
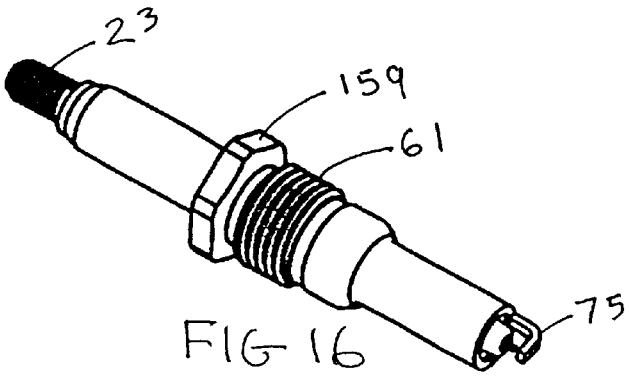

FIG. 6 also illustrates one reason the present invention facilitates spark plug removal as compared to the above noted patented designs. There is initially a small gap 49 between the bore 13 sidewall and the outer cylindrical surface of the ground shield 37. As the engine runs, carbon and other combustion deposits tend to fill this annular gap reducing the clearance between the bore and the spark plug. This reduced clearance necessitates the plug be removed directly axially without any tipping. With a jam nut, as shown in FIG. 16, integral with the remaining spark plug structure, the whole plug is removed in a helical pattern as the nut 159 is unscrewed directly along the axis resulting in negligible tipping and easy removal.

The embodiment of FIGS. 7–9 represents a substantial saving in the cost of the ground shield portion. By welding the L-shaped electrode 73 to an otherwise open-ended cylindrical ground shield portion, the comparatively complex fabrication of the partially closed end is avoided reducing the cost of the ground shield to about 10% of its former value. In this embodiment, the ground shield end portion includes the generally L-shaped member 73 which has a free end 75 radially aligned with and axially spaced from the center electrode tip 77 to form the spark gap. FIG. 16 illustrates and embodiment, similar to that shown in FIGS. 7 and 8, wherein the threaded end portion 61 is formed with an integral hex head nut 159 which can be engaged with a suitable socket tool for removing the spark plug.

The unique technique for fabricating a spark plug in accordance with my invention should now be clear. The insulator 41 or 45 and its included center electrode are axially passed into the cylindrical shell ground shield. In the case of the radial spark gap of FIGS. 1–5, this step of axially passing includes moving the center electrode tip 33 through the aperture 35 and to a position axially aligned with and radially spaced from the shield end 57. The flared frustoconical flange 31 engages the insulator shoulder 29. The cylindrical shell retainer 59 is then axially passed over the insulator from the opposite end and its interior frustoconical ledge 71 engages the insulator second shoulder 69. A portion of the retainer is then radially collapsed about the flange 31 to secure the ground shield and retainer together with the insulator captured therebetween.

Figure 12:
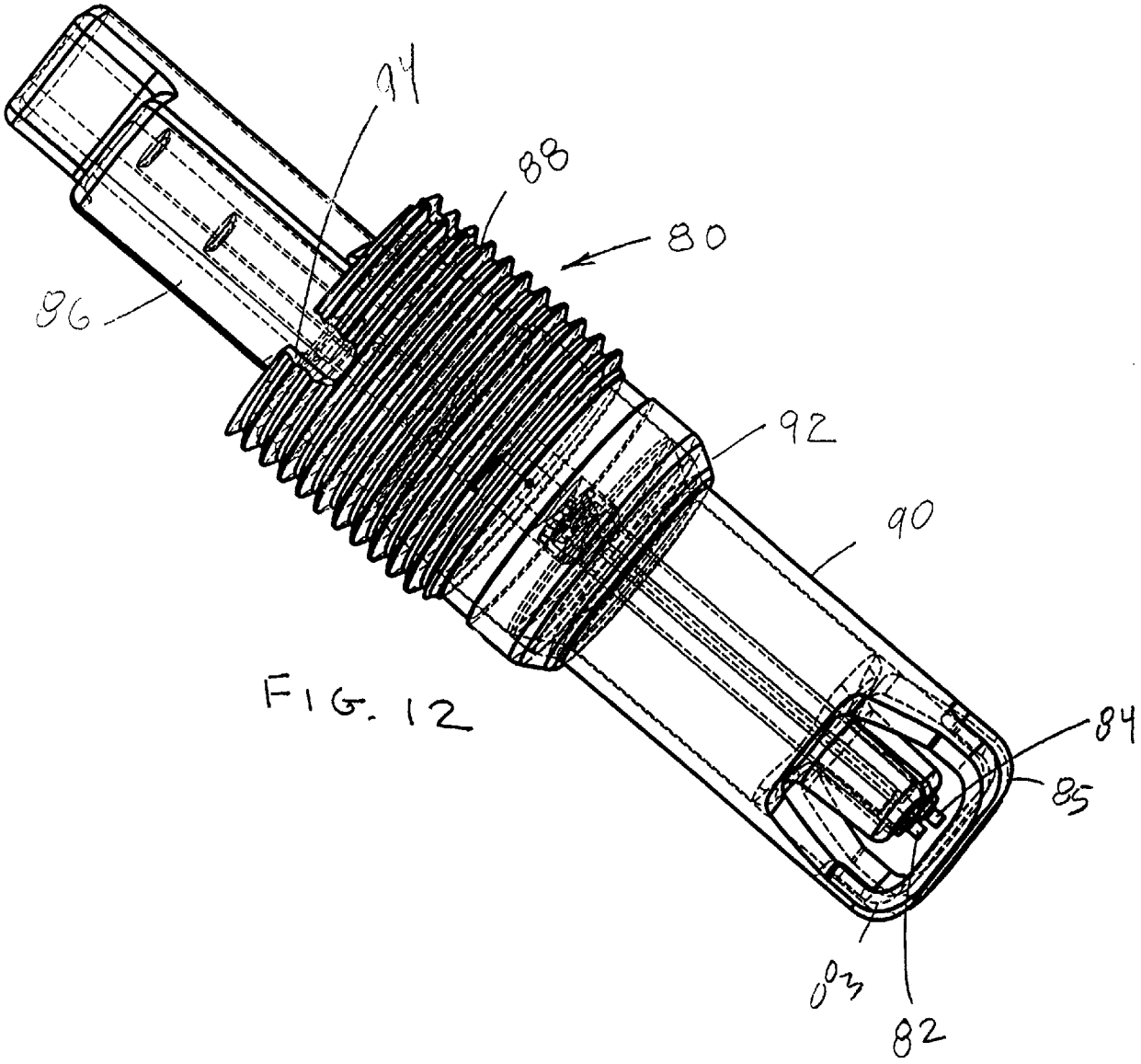
FIG. 12 is a perspective illustration of a dual electrode spark plug according to the present invention.
Figure 13:
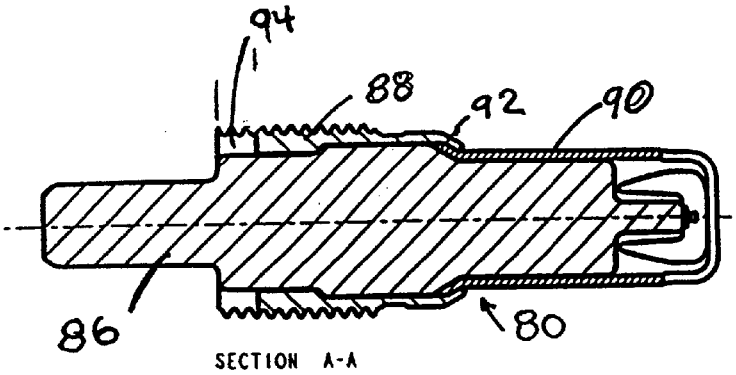
FIG. 13 is a section view of the spark plug shown in FIG. 12 taken between the dual electrodes.
Figure 14:
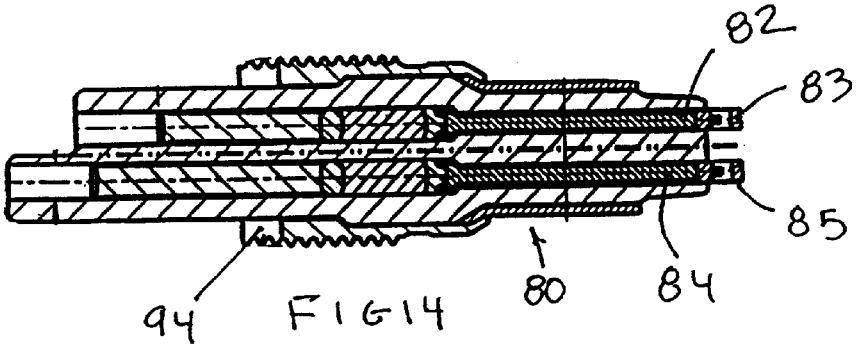
FIG. 14 is a section view taken in FIG. 12 through the dual electrodes.
Figure 15:
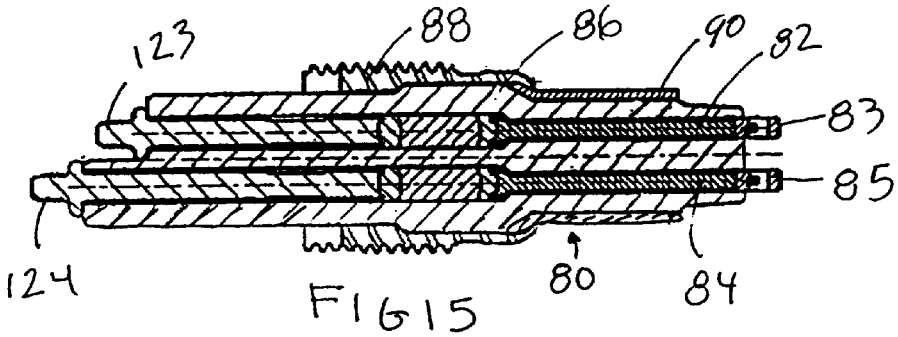
FIG. 15 is a view similar to FIG. 14 showing a dual electrode spark plug with the center electrodes projecting from the terminal end; and, FIG. 16 is a view of a spark plug similar to the spark plug shown in FIGS. 7 and 8 with a nut which can be engaged by a socket tool formed on the threaded end of the ground shield and retainer unit.

Referring now to FIGS. 12, 13, 14 and 15 there is shown a spark plug 80 having dual electrodes 82, 84. Spark plug 80 has a center insulator 86 with an outside shape similar to shapes of the insulators described above. Two bores are formed in insulator 86 for receiving the two center electrodes 82, 84. The firing end or tip of the center electrodes project from insulator 86. In the embodiment of FIGS. 12, 13, and 14 the terminal ends of center electrodes 82, 84 are preferably recessed within the openings formed through insulator 86. However, the terminal ends 123 and 124 of the center electrodes 82 and 84 could also extend from the end of insulator 86 as shown in FIG. 15.

A cylindrical shaped retainer 88 surrounds two larger diameter portions of the insulator 86. A cylindrical shaped ground shield 90 surrounds a smaller diameter portion of insulator 86 near the end where the center electrodes 82, 84 project from insulator 86. Two ground electrodes 83, 85 project from the free end of ground shield 90. The other end of ground shield 90 is shaped frustoconical and engages a similar shaped mating portion of insulator 86. A portion 92 of retainer 88 overlaps and is collapsed around the frustoconical end of ground shield 90 to securely hold insulator 86 in position between portions of retainer 88 and ground shield 90. In this embodiment, the ground shield end portions includes generally U-shaped stirrups 83, 85 which span the ground shield 90 end and are axially spaced from the center electrodes 82, 84 tips to define spark gaps therebetween. The two ground electrodes 83, 85 could also be L-shaped like the ground electrode 73 shown in FIG. 8.

A male threaded portion of retainer 88 engages the female threaded portion 17 of the generally cylindrical opening or bore 17 into the combustion chamber of an internal combustion engine. The insulator 86 provides a compression transmitting mechanical connection between the retainer 88 and the shield 90 which, when threaded into the engine bore 13, urges the retainer 88 frustoconical portion into engagement with the ground shield 90 frustoconical portion which, in turn, engages the seat portion 19 in the engine to establish an electrical ground between the ground shield 90 and engine head while at the same time sealing the combustion chamber 15 from the surrounding environment. When the retainer 88 is threaded into the bore 13, the retainer flange opposite the threaded end is, of course, also urged into sealing engagement with the bore 13 seat 19.

The annular retainer 88 has a sidewall thickness in the region of its threaded portion which is substantially greater than the sidewall thickness in the region overlapping the end of ground shield 90. Slots 94 are formed in the exposed top of the threaded portion of retainer 88. Alternatively, a nut 159 could be formed integral with the end of retainer 88. A suitable socket tool can engage these slots 94 or nut 159 for screwing spark plug 80 into and out of the engine bore 13.

I claim:

1. A spark plug for an internal combustion engine comprising:

a center electrode having a terminal at one end and a tip at the other end;

an insulator disposed around said center electrode; and, a ground shield and retainer unit, disposed around and attached to a portion of said insulator, having a threaded portion on one end and a ground electrode extending from the other end to define a spark gap with respect to the tip of said center electrode.

2. A spark plug as claimed in claim 1 wherein said ground shield and retainer unit includes a seal portion formed on the ground shield intermediate the threaded portion and the ground electrode to provide a seal with the engine between the spark gap and the outside environment when the spark plug is installed.

3. A spark plug as claimed in claim 1 wherein said ground shield and retainer unit is formed from a first part which includes the threaded portion and a second part which includes the ground electrode; and, the first part and the second part are deformed during manufacturing to be in mechanical engagement with each other and with said insulator to define a unitary part secured against any relative movement.

4. A spark plug as claimed in claim 3 wherein the threaded portion of said ground shield and retainer unit includes a nut head which can be engaged by a tool for installing and removing the spark plug from the engine.

5. A spark plug as claimed in claim 1 wherein the threaded portion of said ground shield and retainer unit includes slots which can be engaged by a tool for installing and removing the spark plug from the engine.

6. A spark plug as claimed in claim 1 comprising:

a second center electrode having a cylindrical body with a tip at one end and a terminal near the other end also disposed within said insulator; and, a second ground electrode extending from said ground shield and aligned with the center electrode tip of said second electrode and defining therewith a spark gap.

7. A spark plug as claimed in claim 6 wherein said ground shield is formed from a first part which includes the threaded portion and a second part which includes the ground electrode; and, said first part and said second part fit around said insulator and are deformed during manufacturing to be in mechanical engagement with each other and with said insulator to secure said first part, said second part and said insulator together as an unitary assembly and against any relative movement.

8. A spark plug as claimed in claim 7 wherein the threaded portion is formed with a configuration which can be engaged by a tool for installing and removing the spark plug.

9. A spark plug as claimed in claim 8 wherein the configuration is a plurality of axially extending slots formed in the threaded portion.

10. A spark plug located in a generally cylindrical spark plug receiving bore in an internal combustion engine, the bore communicating with a combustion chamber of the internal combustion engine and including a threaded portion, a seat portion which is located closer to the combustion chamber than the threaded portion, and a smaller diameter portion, the spark plug comprising;

a center electrode having a cylindrical body with a tip at one end and a terminal near the other end;

an insulator radially surrounding the center electrode and having a substantially cylindrical body;

a ground shield surrounding said insulator including near one end a ground electrode aligned with the center electrode tip and defining therewith a spark gap and near the other end a threaded portion having threads that are matched with the bore threads; and, said ground shield having a portion between the threaded portion and the ground electrode which provides a seal between said ground shield and the seat portion of the bore to establish an electrical ground between said ground shield and the engine while at the same time sealing the combustion chamber from the surrounding environment.

11. A spark plug as claimed in claim 10 wherein said ground shield is formed from a first part which includes the threaded portion and a second part which includes the ground electrode and which extends through the smaller diameter portion of the engine bore; and, said first part and said second part fit around said insulator and are deformed during manufacturing to be in mechanical engagement with each other and with said insulator to secure said first part, said second part and said insulator together as an unitary assembly and against any relative movement.

12. A spark plug as claimed in claim 11 wherein the threaded portion is formed with a configuration which can be engaged by a tool for installing and removing the spark plug.

13. A spark plug as claimed in claim 12 wherein the configuration is a plurality of axially extending slots formed in the threaded portion.

14. A spark plug as claimed in claim 12 wherein the configuration is a nut formed in the threaded portion.

15. A spark plug as claimed in claim 10 comprising:

a second center electrode having a cylindrical body with a tip at one end and a terminal near the other end partially disposed within said insulator; and, a second ground electrode extending from said ground shield and aligned with the center electrode tip of said second electrode and defining therewith a spark gap.

16. A spark plug comprising:

a pair of elongated center electrodes;

an insulator disposed radially around said pair of elongated center electrodes having a first diameter section separated by a first shoulder from a second diameter section and a third diameter section separated by a second shoulder from the second diameter section with the second diameter section located intermediate the first and third diameter sections and the diameter of the second diameter section being greater than the diameters of the first and third diameter sections;

a cylindrical ground shield, having two ground electrodes on one end and a flange on the other end, disposed around the first diameter section with the flange engaging the first shoulder; and, a cylindrical retainer disposed around the third diameter section and the second diameter section including an internal portion which engages the second shoulder and an end portion which engages said cylindrical ground shield near the first shoulder to capture said insulator therebetween.

17. A spark plug as claimed in claim 16 wherein:

said elongated center electrodes each have a terminal on one end and a tip on the other end to define a spark gap with respect to the ground electrodes; and, said cylindrical retainer has another end portion which has external threads.

18. A spark plug as claimed in 16 wherein said ground electrodes are each L-shaped having a free end radially aligned with and axially spaced from one of the center electrode tips.

19. A spark plug as claimed in 16 wherein said ground electrodes are each generally a U-shaped stirrup spanning the free end of said ground shield and axially spaced from one of the center electrode tips.

20. A spark plug located in a generally cylindrical opening communicating with a combustion chamber of an internal combustion engine, the opening including a threaded portion and a seat portion located toward the combustion chamber with respect to the threaded portion, the spark plug comprising;

a pair of center electrodes each having a cylindrical body with a tip at one end and a terminal near the other end;

an insulator radially surrounding the center electrodes and having a substantially cylindrical body with at least first and second diameter sections separated by a shoulder;

a ground shield surrounding said insulator first diameter section and including near one end a section juxtaposed with the insulator shoulder and a pair of ground electrodes near the other end each having a portion thereof aligned with one of the center electrode tips to define therewith a spark gap; and an annular retainer surrounding said insulator second diameter section and including a threaded end for engaging the threaded portion of the generally cylindrical opening and the other end overlapping the ground shield section and juxtaposed insulator shoulder for securing the ground shield and retainer together with the insulator captured therebetween.

21. A spark plug located in a generally cylindrical spark plug receiving bore in an internal combustion engine, the bore communicating with a combustion chamber of the internal combustion engine and including a threaded portion and a seat portion, the spark plug comprising;

a pair of electrode each having a cylindrical body with a tip at one end and a terminal near the other end;

an insulator radially surrounding the center electrodes and having a substantially cylindrical body with at least first and second diameter sections separated by a shoulder;

a ground shield surrounding said insulator first diameter section and including near one end a section located proximate the insulator shoulder and a pair of ground electrode extending from the other end each having a portion thereof aligned with one of the center electrode tips to define therewith a spark gap; and an annular retainer surrounding said insulator second diameter section and including a portion having threads that are matched with the bore threads, the annular retainer providing a seal between the ground shield and the seat portion of the bore to establish an electrical ground between the shield and the engine while at the same time sealing the combustion chamber from the surrounding environment.

* * * * *